US011459901B1

(12) United States Patent
Barker et al.

(10) Patent No.: US 11,459,901 B1
(45) Date of Patent: Oct. 4, 2022

(54) AIRFOIL WITH DUAL-WALL COOLING AND ANGLED COOLING CHANNELS

(71) Applicant: Rolls-Royce Corporation, Indianapolis, IN (US)

(72) Inventors: Brett Barker, Indianapolis, IN (US); Eric Koenig, Indianapolis, IN (US); Bruce Varney, Indianapolis, IN (US); Kyle Uhlenhake, Indianapolis, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 0 days.

(21) Appl. No.: 17/481,006

(22) Filed: Sep. 21, 2021

(51) Int. Cl.
*F01D 9/04* (2006.01)
*F01D 9/06* (2006.01)

(52) U.S. Cl.
CPC ..... *F01D 9/065* (2013.01); *F01D 9/041* (2013.01); *F05D 2220/32* (2013.01); *F05D 2240/12* (2013.01); *F05D 2240/81* (2013.01)

(58) Field of Classification Search
CPC ..... F01D 9/065; F01D 9/041; F01D 5/147; F01D 5/189; F01D 5/187; F01D 5/186; F01D 5/141; F01D 5/18; F01D 5/188; F01D 5/14; F01D 11/24; F01D 25/12; F05D 2220/32; F05D 2240/12; F05D 2240/81; F05D 2240/126; F05D 2240/127; F05D 2240/304; F05D 2240/305; F05D 2240/306; F05D 2240/124; F05D 2240/123; F05D 2240/122; F05D 2260/201; F05D 2260/202; F05D 2260/22141; F05D 2260/204; F05D 2260/2212; F05D 2260/607; F05B 2260/2241
See application file for complete search history.

(56) References Cited

U.S. PATENT DOCUMENTS 7,067,447 B2 * 6/2006 Campbell ..... C04B 37/008 416/241 B
10,450,873 B2 10/2019 Barker et al.
(Continued)

OTHER PUBLICATIONS

Varney et al., "Fine Particulate Deposition in an Effusion Plate Geometry," Journal of Turbomachinery, 143 (2021) pp. 011001-1-011001-10.

(Continued)

*Primary Examiner* — Eric J Zamora Alvarez
(74) *Attorney, Agent, or Firm* — Crowell & Moring LLP

(57) ABSTRACT

An airfoil with dual-wall cooling for a gas turbine engine comprises a spar having a pressure side wall and a suction side wall meeting at a leading edge and a trailing edge of the airfoil. An interior of the spar comprises a coolant cavity. The suction side wall includes an arrangement of rails on an outer surface thereof, where each rail extends along a non-chordal direction and terminates at or near the trailing edge. The airfoil also comprises a suction side coversheet overlying the suction side wall, where an inner surface of the suction side coversheet is in contact with the arrangement of rails so as to define a plurality of angled channels between the suction side wall and the suction side coversheet. The suction side wall also comprises inlet holes in fluid communication with the coolant cavity for feeding coolant to the angled channels, and the arrangement of rails is configured to direct the coolant through the angled channels and toward the trailing edge of the airfoil.

20 Claims, 3 Drawing Sheets

(56) References Cited

U.S. PATENT DOCUMENTS

| | | | | |
|---|---|---|---|---|
| 10,626,731 | B2 | 4/2020 | Barker et al. | |
| 10,648,341 | B2 | 5/2020 | Barker et al. | |
| 2017/0030199 | A1* | 2/2017 | Barker | F01D 5/147 |
| 2018/0163554 | A1* | 6/2018 | O'Leary | F01D 5/147 |
| 2018/0230833 | A1* | 8/2018 | Kush | F01D 5/082 |
| 2020/0182071 | A1* | 6/2020 | Spangler | F01D 5/147 |
| 2021/0123352 | A1* | 4/2021 | Townes | F01D 9/065 |
| 2021/0215063 | A1 | 7/2021 | Prenter et al. | |

OTHER PUBLICATIONS

Boulanger et al., "Experimental Based Empirical Model of the Initial Onset of Sand Deposits on Hastelloy-X from 1000C to 1100C Using Particle Tracking," Proceedings of ASME Turbo Expo 2017: Turbomachinery Technical Conference and Exposition GT2017, Charlotte, NC (2017), 11 pp.

Kandlikar et al., "Heat Transfer in Microchannels-2012 Status and Research Needs," Journal of Heat Transfer, 135 (2013), pp. 091001-1-091001-18.

* cited by examiner

AIRFOIL WITH DUAL-WALL COOLING AND ANGLED COOLING CHANNELS

TECHNICAL FIELD

This disclosure relates generally to cooling of airfoils and more particularly to a dual-wall cooling scheme that includes angled cooling channels.

BACKGROUND

Gas turbine engines include a compressor, combustor and turbine in flow series along a common shaft. Compressed air from the compressor is mixed with fuel in the combustor to generate hot combustion gases that rotate the turbine blades and drive the compressor. Improvements in the thrust and efficiency of gas turbine engines are linked to increasing turbine entry temperatures, which places a heavy burden on turbine blades. Consequently, there is significant interest in developing improved cooling techniques for airfoils in gas turbine engines. Dual-wall or double-wall cooling configurations are promising advancements for the cooling of turbine blades.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

A dual-wall or double-wall airfoil for a gas turbine engine may include a hollow spar that is partially or completely surrounded by suction side and pressure side coversheets (or "skins") and spaced apart from the coversheets by raised features on the outer surface of the spar. These raised features may include pedestals and/or rails arranged to define a flow pathway for coolant (e.g., air) between the outer surface of the spar and the respective coversheet. The coolant may provide heat transfer and cooling as it traverses the flow pathway before exiting, typically through exit holes or slots in the respective coversheet. A problem with conventional rails, which may be aligned in a chordal or chordwise direction near the trailing edge of the airfoil, is the trapping of particulate debris that may enter the flow pathway along with the coolant. Sand particles and/or other particulate debris can stick upon impact with side walls of the rails, and the centrifugal force to which the airfoil (e.g., turbine blade) is exposed can increase the number of impacts, particularly on the radially-inward facing side walls, leading to trapped particles.

Figure 1:
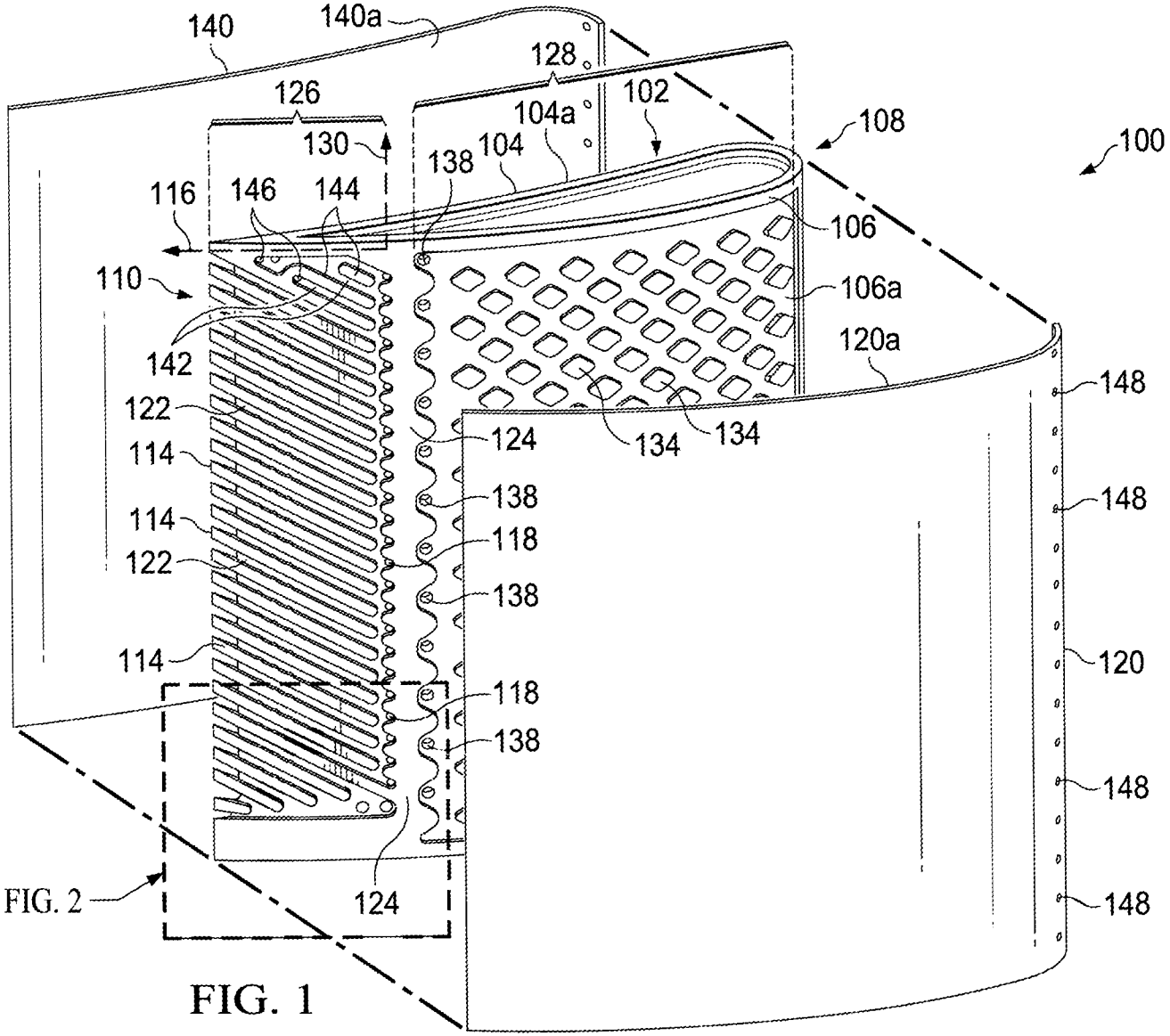
FIG. 1 is an exploded assembly view of an exemplary airfoil with dual-wall cooling and angled channels.

FIG. 1 illustrates an airfoil with dual-wall cooling for a gas turbine engine that may overcome the aforementioned problem. The airfoil 100 comprises a spar 102 having a pressure side wall 104 and a suction side wall 106 meeting at a leading edge 108 and a trailing edge 110 of the airfoil

Figure 2:
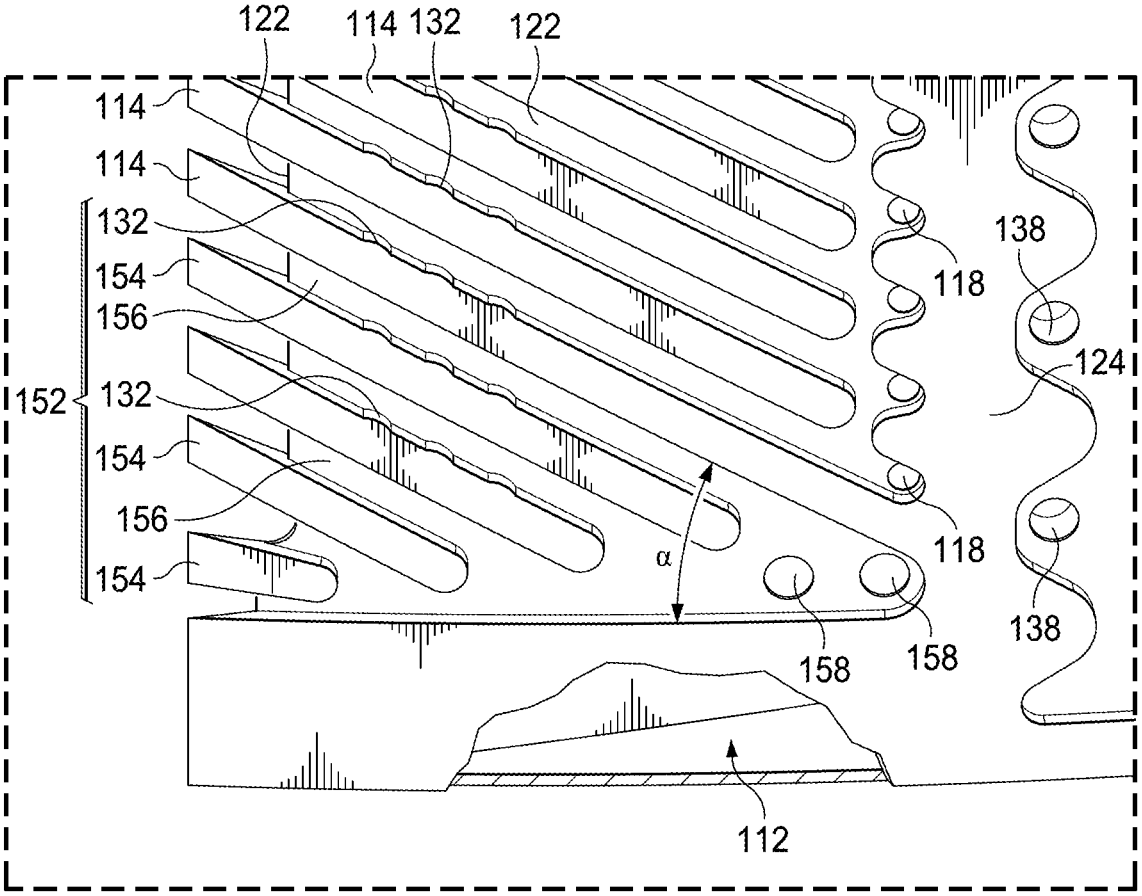
FIG. 2 is a close-up view of part of the airfoil (spar) shown in FIG. 1 to show additional details of the angled channels.

100. An interior of the spar 102 includes one or more coolant cavities 112, shown in FIG. 2, which are fed with a coolant such as air or another suitable cooling fluid. The suction side wall 106 includes an arrangement of rails 114 on an outer surface 106*a* thereof. Each rail 114 is oriented away from a chordwise direction 116 and terminates at or near the trailing edge 110. In other words, each rail 114 extends along a non-chordal direction that has both a chordal component and a radial component before terminating at or near the trailing edge 110. A suction side coversheet 120 overlies the suction side wall 106, and an inner surface 120*a* of the suction side coversheet 120 is in contact with (e.g., bonded to or integrally formed with) the rails 114 so as to define a plurality of angled channels 122 between the suction side wall 106 and the suction side coversheet 120. The suction side wall 106 further comprises inlet holes 118, as indicated in FIG. 2, which are in fluid communication with the coolant cavity 112 and positioned to feed coolant to the angled channels 122. The arrangement of rails 114 is configured to direct the coolant through the angled channels 122 and toward the trailing edge 110 of the airfoil 100. Each of the inlet holes 118 may be in fluid communication with one or more of the angled channels 122. The arrangement of rails 114 may be a parallel arrangement where most or all of the rails 114 are positioned parallel to each other. Alternatively, some or all of the rails 114 may be positioned nonparallel to each other. Typically, the rails 114 are straight, as shown in FIGS. 1 and 2, but in some examples the rails 114 may include one or more curves or bends, e.g., to facilitate expulsion of both coolant and particulate debris at the trailing edge 110.

Situated radially above the arrangement of rails 114 are one or more (e.g., two) shorter rails 144 in contact with the inner surface 120*a* of the suction side coversheet 120 so as to define topmost channels 142 which terminate at crossover holes 146 near the tip of the airfoil 100. The topmost channels 142 may be fed from the inlet holes 118 positioned nearest the tip of the airfoil 100 and may transfer the coolant through the crossover holes 146 from the suction side to the pressure side of the airfoil 100, where the coolant is ejected. The shorter rails 144 may extend along a non-chordal direction, preferably in parallel with the rails 114 in the arrangement, as shown, and may be described as shorter rails 144 due to their shorter length in comparison with the rails 114 in the arrangement. Situated radially below the arrangement of rails 114 is a wedge-shaped region 152 including several additional rails 154 extending along a non-chordal direction from near the hub of the airfoil 100. The additional rails 154 are in contact with the inner surface 120*a* of the suction side coversheet 120 so as to define lowermost channels 156 that deliver coolant to the trailing edge 110 and which may be fed from one or more bottom inlet holes 158 in fluid communication with the one or more coolant cavities 112.

Since the direction along which each rail 114 extends has both a chordal and radial component, the rails 114 may be described as being oriented away from, or deviating from, the chordal direction 116 by an angle $\alpha$, as illustrated in FIG. 2. Accordingly, each of the angled channels 122 may have an orientation with respect to the chordal direction 116 determined by the adjacent rails 114. Typically, the angle $\alpha$ lies in a range from about 10 degrees to about 70 degrees. Each rail 114 may be oriented at an angle $\alpha$ from the chordwise direction 116 of at least about 30 degrees, at least about 40 degrees, or at least about 50 degrees, with angles of up to about 60 degrees, or up to about 70 degrees, being possible. These angular values may also describe the orientation of the shorter rails 144 and the additional rails 154 described above. Since, in use, the airfoil 100 is subjected to centrifugal forces aligned with the positive radial direction 130, the deviation of the rails 114 from the chordal direction 116 preferably has a significant positive radial component to promote dislodging of particulate debris from the angled channels 122. Rails 114 oriented at large (positive) angles α away from the chordwise direction 116, as shown in FIG. 2, may be particularly effective at avoiding particle trapping. On the other hand, the wedge-shaped region 152 below the arrangement of rails 114 increases in size at larger angles α, thereby placing a greater demand on the bottom inlet holes 158 to provide sufficient coolant flow to purge the lowermost channels 156. To provide a balance, the angle α typically lies within the range from about 30 degrees to about 50 degrees.

Advantageously, since the above-described orientation of the rails 114 provides a longer channel 122 for coolant flow than a conventional chordwise channel, the coolant may absorb more heat from the airfoil 100 before exiting at the trailing edge 110, leading to an improvement in cooling efficiency. Each rail 114 or angled channel 122 has a length comprising a chordal component (which may be referred to as a "chordal length component") and a radial component, where the chordal length component may extend over at least about 10% of a total length of the suction side wall 106 along the chordal direction 116. The chordal length component of each rail 114 or angled channel 122 typically extends over no more than about 40%, or no more than about 30%, of the total length, due to the presence of multiple cooling circuits over the suction side wall 106, as discussed below. The spacing between adjacent rails 114 may be at least about 0.5 mm, and is more typically in a range from about 0.6 mm to 5 mm. The spacing may be understood to define a width of each angled channel 122. Each rail 114 may have a width in a range from about 0.7 mm to about 5 mm. Typically, the rails have 114 a height in a range from about 0.25 mm to about 0.8 mm, where the height of the rails 114 may be understood to define a depth of the angled channels 122.

Sidewalls of the rails 114 may be smooth over part or all of the length and/or may include turbulators 132, as shown according to one example in FIG. 2. The turbulators 132 may be understood to be protruding or recessed features (e.g., bumps, ramps, or serrations) in the sidewall 114 designed to promote mixing of the coolant and consequently improved heat transfer as the coolant passes through the angled channels 122. A sidewall or portion of a sidewall described as "smooth" may be understood to be devoid of turbulators. To enhance heat transfer while avoid entrapment of particulate debris, it may be beneficial for the radially outward-facing sidewall of each rail 114 to include one or more turbulators 132, while the radially inward-facing sidewall of each rail 114 is smooth, as illustrated in FIG. 2. It is also contemplated that turbulators may also or alternatively be applied to the inner surface 120*a* of the suction side coversheet 120 in an arrangement that aligns with the angled channels 122, while the outer surface 106*a* of the suction side wall 106 between the rails 114 may remain smooth.

Referring again to FIG. 2, the rails 114 may originate at or near a radial dam 124 on the outer surface 106*a* of the suction side wall 106 that is in contact with (e.g., bonded to or integrally formed with) the inner surface 120*a* of the suction side coversheet 120. The radial dam 124 may be understood to be a radially aligned, elongated raised feature on the outer surface 106*a*, and the phrase "originating near the radial dam 124" may be understood to mean within a few millimeters or centimeters from the radial dam 124. In some examples, one or more of the rails 114 may extend continuously from the radial dam 124. However, having rails 114 that are not continuous with the radial dam 124, as shown in FIG. 1, creates additional radial passages between the channels 122 that may allow each inlet hole 118 to feed coolant to more than one channel 122. This feature may be particularly important for distributing coolant should any of the inlet holes 118 become blocked in use.

The radial dam 124 may separate a first cooling circuit 126 from a second cooling circuit 128, as shown in FIG. 1, where both cooling circuits 126,128 lie between the suction side wall 106 and the suction side coversheet 120. The first cooling circuit 126 may include the angled channels 122 and the second cooling circuit 128 may include one or more flow pathways defined by a second arrangement of pedestals and/or rails 134 on the outer surface 106*a* of the suction side wall 106. In the example of FIG. 1, pedestals 134 are shown, in particular, pedestals 134 having a diamond shape; however, the pedestals 134 are not limited to this geometry and may also or alternatively include other curved or polygonal shapes. Furthermore, there may be additional cooling circuits beyond the first and second cooling circuits 126,128 illustrated in FIG. 1. The one or more flow pathways of the second cooling circuit 128 and/or any additional cooling circuits may be configured to direct coolant emerging from additional inlet holes 138 in the suction side wall 106 toward the leading edge 108 of the airfoil or in another direction suitable for cooling, typically before exiting through exit holes 148 in the suction side coversheet 120. The inlet holes 118 that supply the coolant to the angled channels 122 may be arranged in a column (i.e., along the radial direction) on the suction side wall 106. As shown in the example of FIG. 1, the inlet holes 118 may be directly adjacent to the radial dam 124 on a side of the dam 124 closer to the trailing edge 110.

As shown in FIG. 1, the airfoil 100 may further comprise a pressure side coversheet 140 overlying the pressure side wall 104, where the pressure side wall 104 may comprise one or more arrangements of pedestals and/or rails on an outer surface 104*a* thereof. The arrangements may be the same as or different from the arrangements on the outer surface 106*a* of the suction side wall 106. An inner surface 140*a* of the pressure side coversheet 140 may be in contact with (e.g., bonded to or integrally formed with) the pedestals and/or rails so as to define one or more cooling circuits between the pressure side wall 104 and the pressure side coversheet 140, as discussed above in regard to the suction side wall 106. For example, the rails on the outer surface 104*a* of the pressure side wall 104 may extend in a non-chordal direction and may have any or all of the features described above or elsewhere in this disclosure for the rails 114,144,154 on the suction side wall 106. The pressure side wall 104 may further comprise one or more arrangements of inlet holes in fluid communication with the coolant cavity 112 and positioned to facilitate feeding of coolant to the pressure side cooling circuit(s).

The dual-wall airfoil 100 described herein may be fabricated using investment casting and diffusion bonding methods known in the art, such as described in U.S. Pat. No. 6,003,754, entitled "Airfoil for a Gas Turbine Engine and Method of Manufacture," which is hereby incorporated by reference in its entirety. The airfoil 100, including the spar 102 and the pressure and suction side coversheets 140,120, may be formed from one or more materials that have high melting points, good oxidation/corrosion resistance and high-temperature strength. For example, a nickel-base alloy, a titanium-base alloy, and/or an iron-base alloy may be suitable. The alloy may have an equiaxed, directionally solidified, or single-crystal microstructure. The rails 114,

144,154, radial dam 124, pedestals 134, and any additional raised features may be integrally formed with the airfoil 100, or, more specifically, may be integrally formed on the respective suction or pressure side wall 106,104. The above-mentioned raised features may be bonded to or integrally formed with the respective suction or pressure side coversheet 120,140. The airfoil 100 may have a single-piece or a multi-piece construction.

Figure 3:
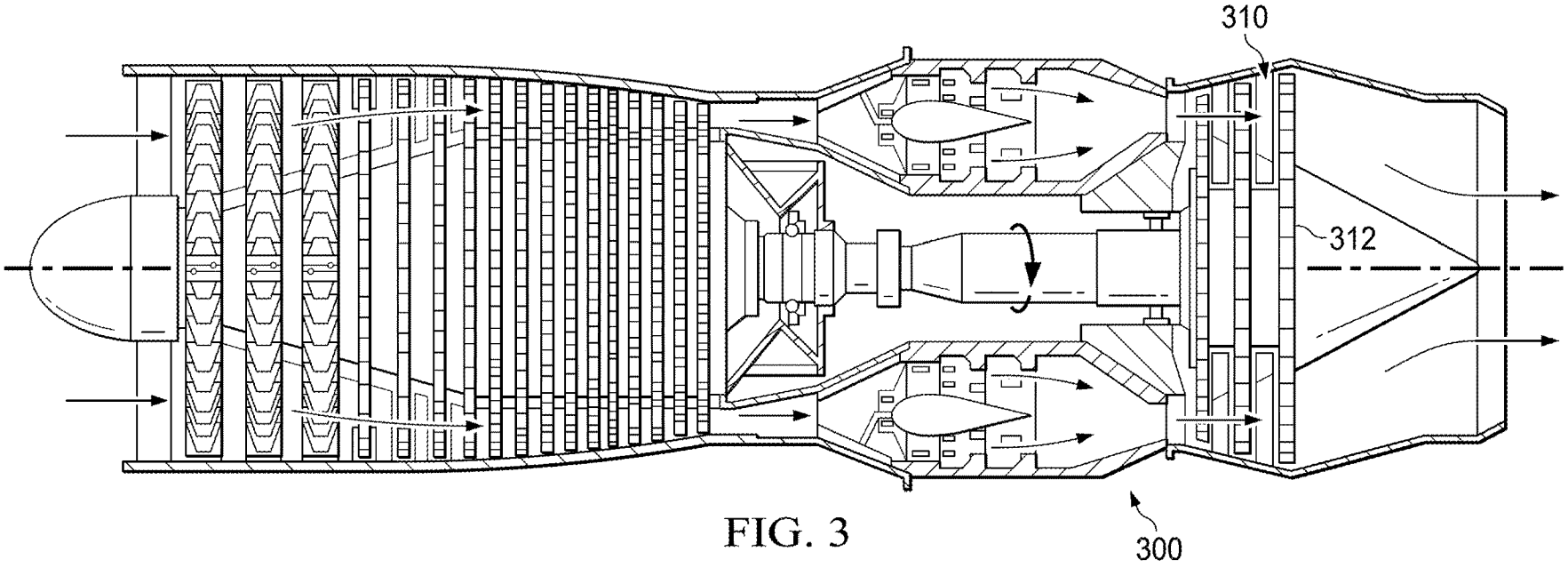
FIG. 3 is a cross-sectional view of an exemplary gas turbine engine that may include the airfoil described in this disclosure.

A gas turbine engine 300, such as that shown in FIG. 3, may include the airfoil 100 described above, e.g., as a turbine blade 312 in the turbine section 310. Advantageously, when in use in the gas turbine engine 300, the non-chordal rails 114 may minimize or eliminate the problem of trapped particles, and thus the angled channels 122 of the airfoil 100 may remain substantially free of particulate debris. In some examples, the gas turbine engine 300 may supply power to and/or provide propulsion of an aircraft, e.g., a helicopter, an airplane, an unmanned space vehicle, a fixed wing vehicle, a variable wing vehicle, a rotary wing vehicle, an unmanned combat aerial vehicle, a tailless aircraft, a hover craft, and/or an extraterrestrial (spacecraft) vehicle. Also or alternatively, the gas turbine engine 300 may be utilized in a configuration unrelated to an aircraft such as, for example, an industrial application, an energy application, a power plant, a pumping set, a marine application (for example, for naval propulsion), a weapon system, a security system, a perimeter defense or security system.

To clarify the use of and to hereby provide notice to the public, the phrases "at least one of <A>, <B>, . . . and <N>" or "at least one of <A>, <B>, . . . or <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

A first aspect relates to an airfoil with dual wall cooling for a gas turbine engine, the airfoil comprising: a spar having a pressure side wall and a suction side wall meeting at a leading edge and a trailing edge of the airfoil, the suction side wall including an arrangement of rails on an outer surface thereof, each rail extending along a non-chordal direction and terminating at or near the trailing edge, an interior of the spar comprising a coolant cavity; and a suction side coversheet overlying the suction side wall, an inner surface of the suction side coversheet being in contact with the arrangement of rails so as to define a plurality of angled channels between the suction side wall and the suction side coversheet, wherein the suction side wall further comprises inlet holes in fluid communication with the coolant cavity for feeding coolant to the angled channels, and wherein the arrangement of rails is configured to direct the coolant through the angled channels and toward the trailing edge of the airfoil.

A second aspect relates to the airfoil of the first aspect, wherein the rails are oriented away from a chordal direction by an angle $\alpha$ in a range from about 10 degrees to about 70 degrees.

A third aspect relates to the airfoil of the second aspect, wherein the angle $\alpha$ is in the range from about 30 degrees to about 50 degrees.

A fourth aspect relates to the airfoil of any preceding aspect, wherein the arrangement of rails comprises a parallel arrangement of the rails.

A fifth aspect relates to the airfoil of any preceding aspect, wherein the rails are integrally formed with the suction side wall.

A sixth aspect relates to the airfoil of any preceding aspect, wherein sidewalls of the rails are smooth.

A seventh aspect relates to the airfoil of any preceding aspect, wherein sidewalls of the rails include one or more turbulators.

An eighth aspect relates to the airfoil of any preceding aspect, wherein each rail includes a radially-outward facing sidewall that includes one or more turbulators, and a radially-inward facing sidewall that is smooth.

A ninth aspect relates to the airfoil of any preceding aspect, wherein a width of each angled channel is in a range from about 0.6 mm to about 5 mm.

A tenth aspect relates to the airfoil of any preceding aspect, wherein the inlet holes are arranged in a column on the suction side wall.

An eleventh aspect relates to the airfoil of any preceding aspect, further comprising a radial dam on the outer surface of the suction side wall and in contact with the inner surface of the suction side coversheet, wherein the rails originate at or near the radial dam.

A twelfth aspect relates to the airfoil of the eleventh aspect, wherein the inlet holes are directly adjacent to the radial dam on a side of the radial dam closer to the trailing edge.

A thirteenth aspect relates to the airfoil of the eleventh or twelfth aspects, wherein the radial dam separates a first cooling circuit comprising the angled channels from a second cooling circuit, which is disposed between the suction side wall and the suction side coversheet and is configured to direct the coolant toward the leading edge.

A fourteenth aspect relates to the airfoil of any preceding aspect, further comprising, situated radially above the arrangement of rails, one or more shorter rails in contact with the inner surface of the suction side coversheet so as to define topmost channels extending along a non-chordal direction, the topmost channels terminating at crossover holes for delivering the coolant from a suction side to a pressure side of the airfoil.

A fifteenth aspect relates to the airfoil of any preceding aspect, further comprising, situated radially below the arrangement of rails, a region including additional rails extending away from a hub of the airfoil along a non-chordal direction, the additional rails being in contact with the inner surface of the suction side coversheet so as to define lowermost channels for delivering coolant to the trailing edge.

A sixteenth aspect relates to the airfoil of any preceding aspect, wherein each of the angled channels has a chordal length component extending over at least about 10% of a total length of the suction side wall along a chordal direction.

A seventeenth aspect relates to the airfoil of the sixteenth aspect, wherein the chordal length component extends over no more than about 40% of the total length.

An eighteenth aspect relates to the airfoil of any preceding aspect, further comprising a pressure side coversheet overlying the pressure side wall, wherein the pressure side wall comprises an arrangement of pedestals or rails on an outer surface thereof, and a plurality of holes in fluid communication with the coolant cavity, and wherein an inner surface of the pressure side coversheet is in contact with the arrangement of pedestals or rails so as to define one or more flow paths between the pressure side wall and the pressure side coversheet.

A nineteenth aspect relates to the airfoil of the eighteenth aspect, wherein the rails on the outer surface of the pressure side wall extend along a non-chordal direction.

A twentieth aspect relates to a gas turbine engine including the airfoil of any preceding aspect.

A twenty-first aspect relates to the gas turbine engine of the twentieth aspect, wherein the airfoil is a turbine blade.

In addition to the features mentioned in each of the independent aspects enumerated above, some examples may show, alone or in combination, the optional features mentioned in the dependent aspects and/or as disclosed in the description above and shown in the figures.

What is claimed is:

1. An airfoil with dual wall cooling for a gas turbine engine, the airfoil comprising:

a spar having a pressure side wall and a suction side wall meeting at a leading edge and a trailing edge of the airfoil, the suction side wall including an arrangement of rails on an outer surface thereof, each rail extending along a non-chordal direction and terminating at or near the trailing edge, an interior of the spar comprising a coolant cavity; and a suction side coversheet overlying the suction side wall, an inner surface of the suction side coversheet being in contact with the arrangement of rails so as to define a plurality of angled channels between the suction side wall and the suction side coversheet, wherein the suction side wall further comprises inlet holes in fluid communication with the coolant cavity for feeding coolant to the plurality of angled channels, and wherein the arrangement of rails is configured to direct the coolant through the plurality of angled channels and toward the trailing edge of the airfoil.

2. The airfoil of claim 1, wherein the rails are oriented away from a chordal direction by an angle $\alpha$ in a range from 10 degrees to 70 degrees.

3. The airfoil of claim 2, wherein the angle $\alpha$ is in the range from 30 degrees to 50 degrees.

4. The airfoil of claim 1, wherein the arrangement of rails comprises a parallel arrangement of the rails.

5. The airfoil of claim 1, wherein the rails are integrally formed with the suction side wall.

6. The airfoil of claim 1, wherein sidewalls of the rails are smooth.

7. The airfoil of claim 1, wherein sidewalls of the rails include one or more turbulators.

8. The airfoil of claim 1, wherein each rail includes a radially-outward facing sidewall that includes one or more turbulators, and a radially-inward facing sidewall that is smooth.

9. The airfoil of claim 1, wherein a width of each angled channel is in a range from 0.6 mm to 5 mm.

10. The airfoil of claim 1, wherein the inlet holes are arranged in a column on the suction side wall.

11. The airfoil of claim 1, further comprising a radial dam on the outer surface of the suction side wall and in contact with the inner surface of the suction side coversheet, wherein the rails originate at or near the radial dam.

12. The airfoil of claim 11, wherein the inlet holes are directly adjacent to the radial dam on a side of the radial dam closer to the trailing edge.

13. The airfoil of claim 11, wherein the radial dam separates a first cooling circuit comprising the plurality of angled channels from a second cooling circuit disposed between the suction side wall and the suction side coversheet and configured to direct the coolant toward the leading edge.

14. The airfoil of claim 1, further comprising, situated radially above the arrangement of rails, one or more shorter rails in contact with the inner surface of the suction side coversheet so as to define topmost channels extending along the non-chordal direction, the topmost channels terminating at crossover holes, wherein the crossover holes deliver the coolant from a suction side to a pressure side of the airfoil.

15. The airfoil of claim 1, further comprising, situated radially below the arrangement of rails, a region including additional rails extending away from a hub of the airfoil along the non-chordal direction, the additional rails being in contact with the inner surface of the suction side coversheet so as to define lowermost channels for delivering coolant to the trailing edge.

16. The airfoil of claim 1, wherein each of the plurality of angled channels has a chordal length component extending over at least 10% of a total length of the suction side wall along a chordal direction.

17. The airfoil of claim 16, wherein the chordal length component extends over no more than 40% of the total length of the suction side wall.

18. The airfoil of claim 1, further comprising a pressure side coversheet overlying the pressure side wall, wherein the pressure side wall comprises an arrangement of pedestals and/or rails on an outer surface thereof, and a plurality of holes in fluid communication with the coolant cavity, and wherein an inner surface of the pressure side coversheet is in contact with the arrangement of pedestals and/or rails so as to define one or more flow paths between the pressure side wall and the pressure side coversheet.

19. The airfoil of claim 18, wherein the rails on the outer surface of the pressure side wall extend along the non-chordal direction.

20. A gas turbine engine including the airfoil of claim 1.

* * * * *